US008104961B2

(12) United States Patent
Sargin

(10) Patent No.: US 8,104,961 B2
(45) Date of Patent: Jan. 31, 2012

(54) BAG AND ZIPPER ASSEMBLY WITH SECURED SIDE GUSSETS

(75) Inventor: Gary F. Sargin, Green Bay, WI (US)

(73) Assignee: Coating Excellence International LLC, Wrightstown, WI (US)

( * ) Notice: Subject to any disclaimer, the term of this patent is extended or adjusted under 35 U.S.C. 154(b) by 344 days.

(21) Appl. No.: 12/409,718

(22) Filed: Mar. 24, 2009

(65) Prior Publication Data

US 2010/0247001 A1 Sep. 30, 2010

(51) Int. Cl.
*B65D 33/16* (2006.01)
*B65D 30/20* (2006.01)

(52) U.S. Cl. ..... 383/64; 383/120

(58) Field of Classification Search ..... 383/78, 383/79, 81, 63, 64, 120
See application file for complete search history.

(56) References Cited

U.S. PATENT DOCUMENTS

| | | | | |
|---|---|---|---|---|
| 2,017,838 | A * | 10/1935 | Webster et al. | 383/119 |
| 2,391,938 | A * | 1/1946 | Webster | 383/78 |
| 2,899,347 | A * | 8/1959 | Kindseth | 156/209 |
| 3,380,646 | A | 4/1968 | Doyen et al. | |
| 3,990,626 | A | 11/1976 | Goodrich | |
| 4,008,850 | A | 2/1977 | Goodrich | |
| 4,241,865 | A * | 12/1980 | Ferrell | 383/204 |
| 4,337,889 | A * | 7/1982 | Moertel | 383/210.1 |
| 4,534,752 | A * | 8/1985 | Ferrell et al. | 493/213 |
| 4,620,320 | A * | 10/1986 | Sullivan | 383/203 |
| 5,048,692 | A | 9/1991 | Handler et al. | |
| 5,364,189 | A | 11/1994 | Kuge et al. | |
| 6,030,123 | A | 2/2000 | Mitarai | |
| 6,367,976 | B1 | 4/2002 | Bannister | |
| 6,398,412 | B2 | 6/2002 | Wedi et al. | |
| 6,464,394 | B1 * | 10/2002 | Galomb | 383/10 |
| 6,800,051 | B2 | 10/2004 | Koen | |
| 6,979,482 | B2 | 12/2005 | Hartzell et al. | |
| 6,991,592 | B2 | 1/2006 | Wold et al. | |
| 7,223,017 | B2 * | 5/2007 | Weaver | 383/63 |
| 7,237,953 | B2 | 7/2007 | Healy et al. | |
| 2002/0021844 | A1 | 2/2002 | Rusert et al. | |
| 2006/0072859 | A1 | 4/2006 | Melchoir et al. | |
| 2006/0228055 | A1 * | 10/2006 | Eads et al. | 383/61.2 |
| 2007/0048480 | A1 | 3/2007 | Lavosky | |
| 2007/0104397 | A1 | 5/2007 | Walker et al. | |
| 2007/0269144 | A1 | 11/2007 | Arnell | |
| 2007/0292053 | A1 | 12/2007 | Lin et al. | |
| 2008/0202971 | A1 | 8/2008 | Robles et al. | |
| 2008/0267539 | A1 | 10/2008 | Howell et al. | |
| 2008/0292223 | A1 | 11/2008 | Bannister | |
| 2009/0052812 | A1 * | 2/2009 | Plourde et al. | 383/64 |
| 2009/0159192 | A1 | 6/2009 | Bannister | |
| 2009/0297817 | A1 | 12/2009 | Olajide, Jr. et al. | |
| 2010/0029455 | A1 | 2/2010 | Skopek et al. | |

FOREIGN PATENT DOCUMENTS

CA 775426 1/1968

(Continued)

OTHER PUBLICATIONS

International Search Report and Written Opinion in PCT/US2010/028084, dated Oct. 26, 2010

*Primary Examiner* — Jes F Pascua
(74) *Attorney, Agent, or Firm* — Duane Morris LLP

(57) ABSTRACT

A bag and zipper assembly includes, side gussets of the bag are at inwardly folded positions between first and second panels. Each side gusset of the bag has a set of one or more gusset openings adjacent an open end of the bag. The first panel has a corresponding set of one or more panel openings, and adhesive extends in each of the openings for the adhesive to adhere the side gussets to the first panel and restrain each side gusset from movement outwardly from between the first and second panels.

6 Claims, 4 Drawing Sheets

FOREIGN PATENT DOCUMENTS

| | | |
|---|---|---|
| CA | 875950 | 7/1971 |
| CA | 2453331 | 1/2004 |
| DE | 20008403 | 5/2000 |
| DE | 10054395 | 11/2000 |
| EP | 0834 454 | 2/2000 |
| JP | 09099958 | 4/1997 |
| JP | 2002211592 | 7/2002 |
| JP | 2003-047507 | 2/2003 |
| JP | 2005-518890 | 6/2005 |
| KR | 10-2004-005162 | 6/2004 |
| WO | WO 03/074371 | 2/2003 |

* cited by examiner

BAG AND ZIPPER ASSEMBLY WITH SECURED SIDE GUSSETS

FIELD OF THE INVENTION

The invention relates to a bag and zipper assembly in which side gussets of the bag are restrained from movement outwardly.

BACKGROUND

U.S. Pat. No. 3,380,646 discloses a bag constructed with a pair of strips that are welded together along lateral edges to form a tube. The tube is welded to a bottom strip. Manufacturing tooling is disclosed to provide the bottom strip with openings to permit a weld to pass through the openings and join together the two strips forming the tube.

A side-gusseted bag is constructed with two side gussets joining a first panel and joining a second panel to form a tube. The side gussets are folded inward to assume positions between the first and second panels. A zipper is assembled over an open end of the tube to close the open end by actuating the zipper. However, the folded inward sides of the bag are able to unfold outwardly from under the zipper to cause openings to occur at the end of the bag. To prevent the openings, the side gussets of the bag were glued after being folded to hold the folded orientations together at the end of the bag. However, when the bag is filled with contents, the side gussets are required to unfold and expand the bag interior, which causes at least a slight openings to occur at the bag sides adjacent the end of the bag.

SUMMARY OF THE INVENTION

The invention provides a bag and zipper assembly, in which side gussets of the bag are at inwardly folded positions between first and second panels. Each side gusset adjacent the first panel has a set of one or more openings adjacent an open end of the bag, and the first panel has a corresponding set of one or more panel openings, and adhesive extends in each set of one or more openings and in each corresponding set of one or more panel openings for the adhesive to adhere the side gussets to the first panel adjacent the open end of the bag and restrain each side gusset from movement outwardly from between the first and second panels.

An advantage of the invention is that the side gussets of the bag are adhered to another panel of the bag preventing the side gussets from movement outwardly from between the panels.

According to an embodiment of the invention, the adhesive adheres to one of the zipper flanges.

According to another embodiment of the invention, the adhesive extends along the first panel adjacent the bag end and secures one of the zipper flanges to the bag.

According to a further embodiment of the invention, additional adhesive extends along the second panel adjacent the bag end and secures another of the zipper flanges to the bag.

According to an alternative embodiment of the invention, the adhesive extends in each of another set of one or more openings through the side gussets, and extends in each corresponding set of one or more second panel openings to adhere the side gussets to the second panel.

A method of making a bag and a zipper assembly includes, penetrating through each side gusset of a bag adjacent a bag end to provide a set of one or more openings through the side gussets at inwardly folded positions between a first panel and a second panel, and penetrating through the first panel to provide a corresponding set of one or more panel openings, and applying adhesive in each set of one or more openings and in each corresponding set of one or more panel openings for the adhesive to adhere the side gussets to the first panel adjacent the open end of the bag and restrain each side gusset from movement outwardly from between the first and second panels.

BRIEF DESCRIPTION OF THE DRAWINGS

Embodiments of the invention will now be described by way of example with reference to the accompanying drawings.

DETAILED DESCRIPTION

Figure 1:
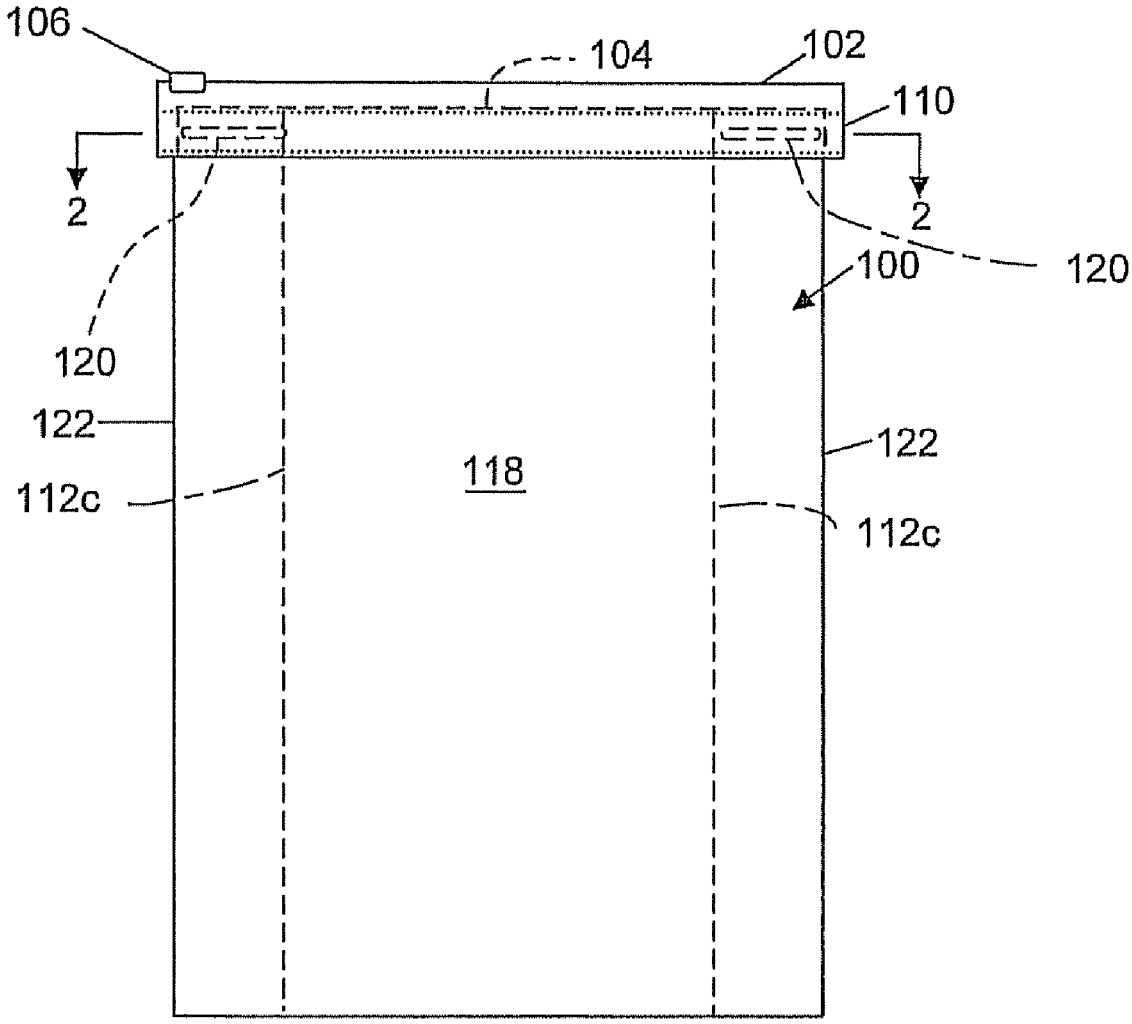
FIG. 1 is a front elevation view of an embodiment of a bag and zipper assembly.
Figure 2:
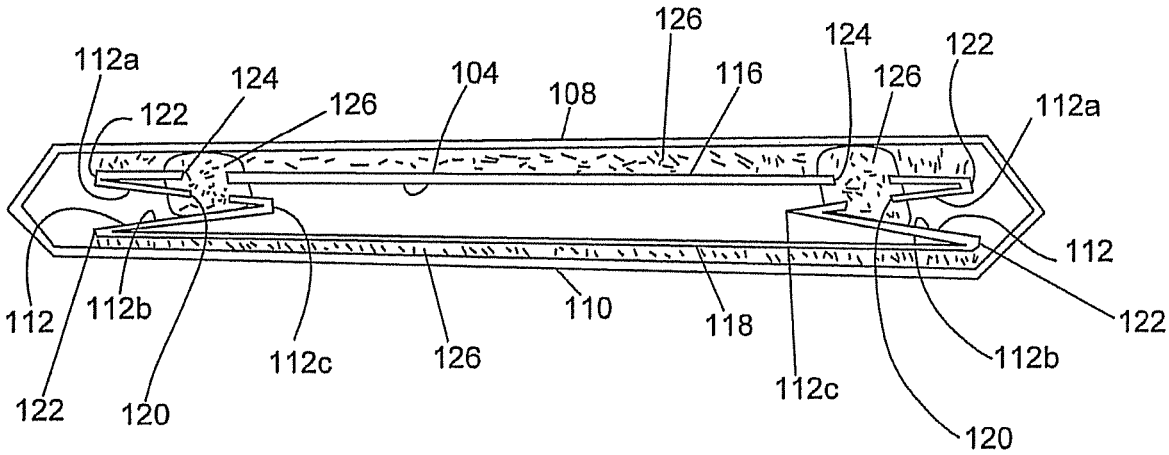
FIG. 2 is an enlarged section along line 2-2 of FIG. 1, with portions of structure separated apart for purposes of illustration.
Figure 3:
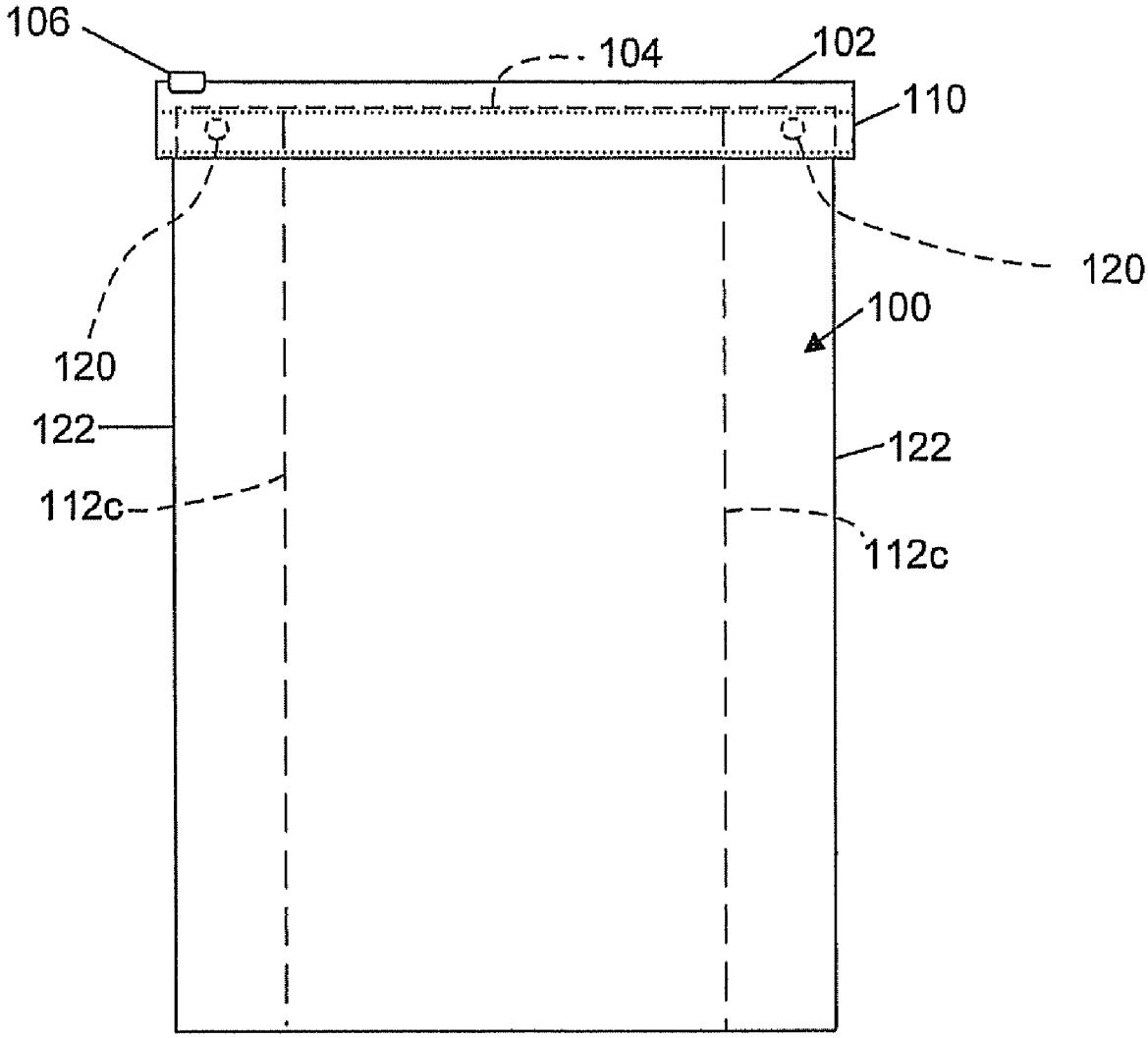
FIG. 3 is a front elevation view of an alternative embodiment of a bag and zipper assembly.
Figure 4:
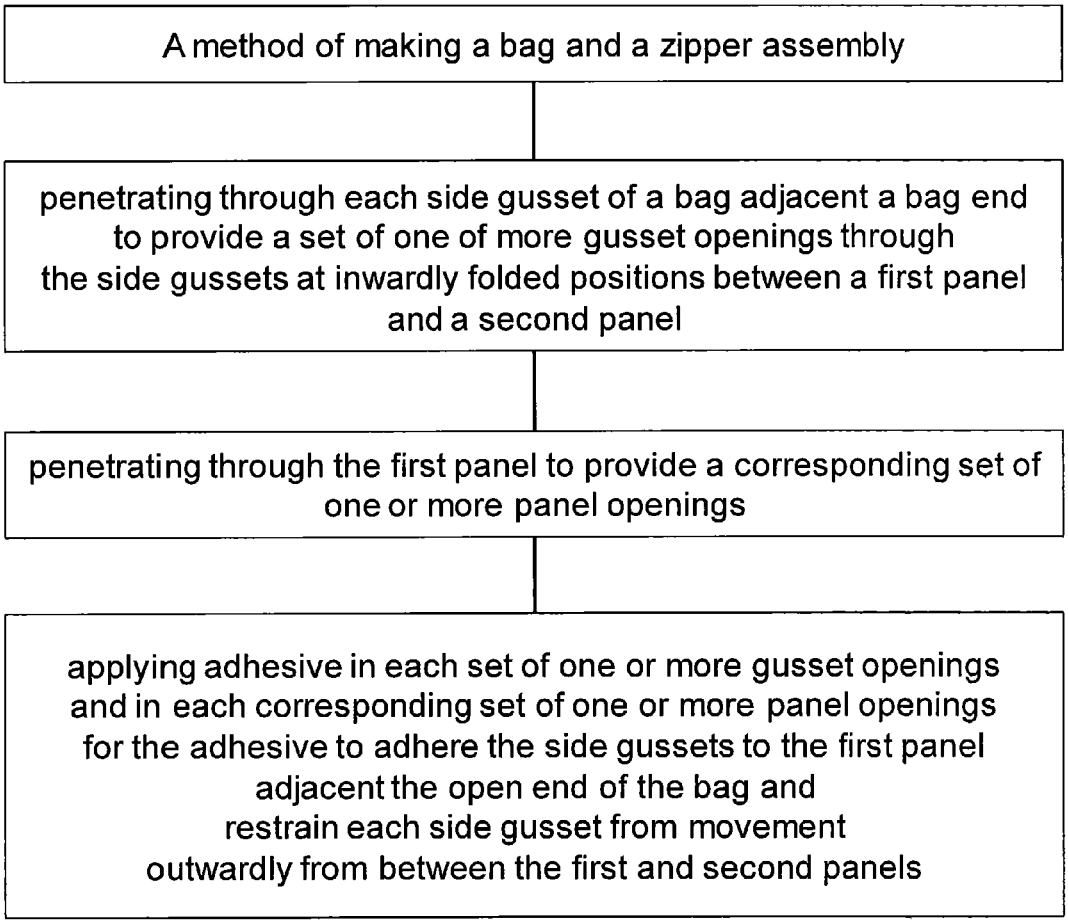
FIG. 4 is a flowchart of the method of making the bag and zipper assembly disclosed in FIGS. 1 through 3.

FIGS. 1 and 3 disclose corresponding embodiments of a bag 100 assembled with a zipper 102. FIGS. 2 and 3 disclose an open bag end 104 to be opened and closed by the zipper 102 having elongated zipper sides that are opened and closed by sliding actuation of a slider 106, FIG. 1. The slider 106 is hand actuated, forward and back along the zipper sides, wherein the elongated zipper sides have elongated zipper flanges 108, 110, respectively, adjacent the bag end 104, and the zipper flanges 108, 110 are secured to the bag 100 adjacent the bag end 104.

FIG. 2 discloses the bag 100 having two side gussets 112, 112 joining a first panel 116 and joining a second panel 118. Each side gusset 112, 112 comprises a first side section 112*a* adjacent the first panel 116, a second side section 112*b* adjacent the second panel 118 and a fold 112*c* along which the first side section 112*a* and the second side section 112*b* are folded. The first side section 112*a* and the second side section 112*b* are folded inwardly, and are in an inwardly folded orientation between the first panel 116 and the second panel 118. Each side gusset 112, 112 is adapted to unfold outwardly from between the first panel 116 and the second panel 118 to expand the bag interior.

FIGS. 1 and 2 disclose each side gusset 112, 112 having a first set of one or more openings 120 through the first side section adjacent the bag end. The number, size and shape of each of the one or more openings 120 are exemplary. For example, FIG. 2 depicts one longitudinal opening 120 or oval opening 120, or FIG. 3 depicts one circular opening 120.

In FIGS. 1-3, the zipper flanges 108, 110 extend to cover the one or more openings 120. The one or more openings 120 through the side gussets 112, 112 are within the inner extremity and the outer extremity of corresponding side gussets 112, 112. The inner extremity is provided along the fold 112*c*. The outer extremity is provided along the folded junctions 122 of each side gusset 112, 112 with the first panel 116 and the second panel 118, respectively. The folded junctions 122 are superposed when the bag 100 is folded. The first set of one or more openings 120 can remain confined within an outer extremity of a corresponding side gusset 112, 112. Further, the zipper flanges 108, 110 extend beyond the outer extremity to cover the one or more openings 120, such that the first set of one or more openings 120 can extend though an outer extremity of a corresponding side gusset 112, 112 and remain covered by the zipper flanges 108, 110.

FIG. 2 discloses each first set of one or more openings 120 being adjacent a corresponding set of one or more panel openings 124 through the first panel 116 adjacent the bag end. The first panel 116 is adjacent each first side section having the first set of one or more openings 120.

FIG. 2 discloses adhesive 126 that extends in each set of one or more openings 120 and extends in each corresponding set of one or more panel openings 124 for the adhesive 126 to adhere the folded side gussets 112, 112 to the first panel 116. For example, the bag can be constructed with a woven interior layer and a nonwoven exterior layer, both of polymeric material including, but not limited to compostable polypropylene. Open spaces between woven strips in the woven interior layer are incapable of sealing the bag 100. The nonwoven exterior layer is an imperforate polymeric material formed as a solid film or formed as a solid film laminate of two or more polymeric layers that serve to seal the bag. Further, the nonwoven exterior layer has a material strength to resist deformation or tearing at the location of the adhesive 126. The adhesive 126 enters the openings 120 and 124 spreads over the exterior imperforate material surface of the first panel 116, and spreads over the exterior imperforate material surfaces of the second side sections 112*b*, 112*b* of the side gussets 112, 112. Thereby, the adhesive 126 provides an adhesive bond to the exterior imperforate surface of the bag that is capable of being sealed by the adhesive 126. The adhesive 126 restrains each side gusset 112, 112 from movement outwardly from between the first panel 116 and the second panel 118 to resist leaking and inadvertent opening of the bag at the side gussets 112, 112.

According to an embodiment of the invention, FIG. 2 discloses that the adhesive 126 emerges from the corresponding set of one or more panel openings 124 and adheres to one of the zipper flanges 108, 110.

According to another embodiment of the invention, the adhesive 126 of additional quantity extends along the first panel 116 adjacent the bag end and secures one of the zipper flanges 108, 110 to the bag. The adhesive 126 can be a continuous quantity or, alternatively, can be separate quantities, provided that the adhesive 126 extends in the openings 120, 124 and along the first panel 126.

According to a further embodiment of the invention, an additional quantity of adhesive 126 extends along the second panel 118 adjacent the bag end 104 and secures another of the zipper flanges 108, 110 to the bag.

A method of making the bag 100 and zipper 102 assembly of FIGS. 1 and 2 includes, penetrating through each first side section 112*a* of the side gussets 112, 112 adjacent the bag end 104 to provide the set of one or more openings 120, and penetrating through the first panel 116 adjacent the bag end 104 to provide each corresponding set of one or more panel openings 124. Such penetrating is performed by a punching or drilling operation using manufacturing punch tooling or drilling tooling. According to embodiments of the invention, the sets of openings 120 and 124 are simultaneously formed or are formed separately. The method further includes, applying the adhesive 126 in a fluent state to the bag 100 adjacent the bag end 104, wherein the adhesive 126 flows and extends in each set of one or more openings 120 and extends in each corresponding set of one or more panel openings 124. The adhesive 126 solidifies and adheres the side gussets 112, 112 to the first panel 116. The adhesive 126 is applied as a hot melt adhesive, by an industrial hot melt applicator, a wheel applicator or by wiping with a brush applicator, along each of the first panel 116 and the second panel 118, preferably while the bag 100 is folded flat. An embodiment of the method includes, extending the adhesive 126 along the bag 100 adjacent the bag end 104, followed by, assembling the zipper 102 to the bag end 104 and securing each of the zipper flanges 108, 110, respectively, to the bag 100 by the adhesive 126 extended along the bag 100.

A method of making the bag 100 and zipper 102 assembly of FIG. 3 includes the method of making the bag 100 and zipper 102 assembly of FIGS. 1 and 2, and further includes, penetrating through each second side section 112*b* of the side gussets 112, 112 adjacent the bag end 104 to provide the set of one or more openings 130, and penetrating through the second panel 118 adjacent the bag end 104 to provide each corresponding set of one or more second panel openings 132. Such penetrating is performed by a punching or drilling operation using manufacturing punch tooling or drilling tooling. According to embodiments of the invention, the sets of openings 130 and 132 are simultaneously formed or are formed separately. The method further includes, applying the adhesive 126 in a fluent state to the bag 100 adjacent the bag end 104, wherein the adhesive 126 flows and extends in each set of one or more openings 130 and extends in each corresponding set of one or more second panel openings 132. The adhesive 126 solidifies and adheres the side gussets 112, 112 to the second panel 118. The adhesive 126 is applied as a hot melt adhesive, by an industrial hot melt applicator, a wheel applicator or by wiping with a brush applicator, along each of the first panel 116 and the second panel 118, preferably while the bag 100 is folded flat. An embodiment of the method includes, extending the adhesive 126 along the bag 100 adjacent the bag end 104, followed by, assembling the zipper 102 to the bag end 104 and securing each of the zipper flanges 108, 110, respectively, to the bag 100 by the adhesive 126 extended along the bag 100.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Patents and patent applications referred to herein are hereby incorporated by reference in their entireties. Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A bag and zipper assembly, comprising:

side gussets of the bag between first and second panels;

each side gusset having a first side section joined by a first fold to the first panel, and a second side section joined by a second fold to the second panel and a third fold along which the first side section and the second side section are folded;

a set of one or more gusset openings solely in the first side section of each side gusset adjacent an open end of the bag;

a corresponding set of one or more panel openings solely in the first panel adjacent said open end of the bag; and adhesive in each of the one or more gusset openings adhering together the first side section and the second side section of each side gusset;

said adhesive extending in the one or more panel openings solely in the first panel, and said adhesive adhering the first side sections of the side gussets to the first panel wherein said adhesive restrains each side gusset from movement outwardly from between the first and second panels adjacent said open end of the bag, and wherein the second panel and the second side sections of the side gussets unfold along the second folds to expand the bag interior adjacent said open end of the bag;

said adhesive combining with additional adhesive adhering the first panel to a first zipper flange of the zipper assembly; and the second panel of the bag being adhered by further adhesive to a second zipper flange of the zipper assembly.

2. The assembly of claim 1 wherein the one or more gusset openings are through a side gusset within an inner extremity and an outer extremity of the first section of the side gusset.

3. The assembly of claim 1 wherein for each side gusset, one of the one or more gusset openings extends through an outer extremity of the first side section of the side gusset, and the zipper flanges extend beyond the outer extremity and cover the one or more gusset openings.

4. A method of making a bag and a zipper assembly, comprising:

penetrating through each side gusset of a bag adjacent an open end of a bag to provide a set of one or more gusset openings solely in a first side section of each side gusset foldably connected to a first panel and a second panel;

penetrating through the first panel to provide a corresponding set of one or more panel openings solely through the first panel adjacent said open end of the bag;

applying adhesive in each of the one or more gusset openings and adhering together the first side section and a second side section of each side gusset adjacent said open end of the bag, and extending the adhesive in the one or more panel openings for the adhesive to adhere the side gussets to the first panel adjacent the open end of the bag and restrain each side gusset from movement outwardly from between the first and second panels, wherein the second panel and the second side sections of the side gussets unfold along the second folds to expand the bag interior adjacent said open end of the bag;

combining the adhesive with additional adhesive adhering the first panel to a first zipper flange of the zipper assembly; and adhering the second panel of the bag by further adhesive to a second zipper flange of the zipper assembly.

5. The method of claim 4 wherein the one or more gusset openings are within an inner extremity and an outer extremity of the side gusset.

6. The method of claim 4 further comprising:

for each side gusset, extending one of the one or more gusset openings beyond an outer extremity of the side gusset, and extending the zipper flanges beyond the outer extremity and covering the one or more gusset openings.

* * * * *